US009453368B2

(12) United States Patent
Burd

(10) Patent No.: US 9,453,368 B2
(45) Date of Patent: Sep. 27, 2016

(54) DOOR SEAL ASSEMBLY

(71) Applicant: B/E Aerospace, Inc., Wellington, FL (US)

(72) Inventor: Peter Burd, Carmarthenshire (GB)

(73) Assignee: B/E Aerospace, Inc., Wellington, FL (US)

( * ) Notice: Subject to any disclaimer, the term of this patent is extended or adjusted under 35 U.S.C. 154(b) by 114 days.

(21) Appl. No.: 14/473,115

(22) Filed: Aug. 29, 2014

(65) Prior Publication Data

US 2015/0061302 A1 Mar. 5, 2015

Related U.S. Application Data

(60) Provisional application No. 61/871,946, filed on Aug. 30, 2013.

(51) Int. Cl.

| | |
|---|---|
| ***E06B 7/20*** | (2006.01) |
| ***E06B 7/18*** | (2006.01) |
| ***E06B 7/205*** | (2006.01) |
| ***E06B 7/215*** | (2006.01) |
| ***E06B 7/26*** | (2006.01) |

(52) U.S. Cl.

CPC . *E06B 7/20* (2013.01); *E06B 7/18* (2013.01); *E06B 7/205* (2013.01); *E06B 7/215* (2013.01); *E06B 7/26* (2013.01); *Y10T 292/48* (2015.04)

(58) Field of Classification Search

CPC ..... E06B 7/20

See application file for complete search history.

(56) References Cited

U.S. PATENT DOCUMENTS

| | | | | | |
|---|---|---|---|---|---|
| 95,902 | A * | 10/1869 | Horner | E06B 7/20 | 49/314 |
| 158,245 | A * | 12/1874 | Chamberlain | E06B 7/20 | 49/314 |
| 158,292 | A * | 12/1874 | Lynch | E06B 7/20 | 49/314 |
| 238,753 | A * | 3/1881 | Bell | E06B 7/20 | 49/315 |
| 266,730 | A * | 10/1882 | Steckel | E06B 7/20 | 49/312 |
| 277,887 | A * | 5/1883 | Conklin | E06B 7/20 | 49/314 |

(Continued)

FOREIGN PATENT DOCUMENTS

| | | | | |
|---|---|---|---|---|
| CA | 2 835 140 A1 | | 4/2013 | |
| FR | 452093 A | * | 5/1913 | E06B 7/20 |

(Continued)

OTHER PUBLICATIONS

ISA/US International Search Report for International Patent Application No. PCT/US2014/053446 dated Dec. 18, 2014.

*Primary Examiner* — Katherine Mitchell
*Assistant Examiner* — Marcus Menezes
(74) *Attorney, Agent, or Firm* — Shumaker, Loop & Kendrick, LLP

(57) ABSTRACT

A door assembly including a swinging door, a sealing member pivotally to the door configured to pivot between a first position into contact with the floor and a second position out of contact with the floor, a lever arranged to actuate pivoting movement of the sealing member in response to opening and closing of the door, a biasing member arranged to bias the lever toward a non-actuating position, and a separate deployment stop arranged to actuate the lever.

20 Claims, 7 Drawing Sheets

(56) References Cited

U.S. PATENT DOCUMENTS 297,636 A * 4/1884 Rowlett ..... E06B 7/20 49/315
327,106 A * 9/1885 Plympton ..... E06B 7/20 49/315
368,917 A * 8/1887 Gift ..... E06B 7/20 49/314
372,084 A * 10/1887 Patterson ..... E06B 7/20 49/314
457,851 A * 8/1891 Ennis ..... E06B 7/20 49/314
481,229 A * 8/1892 Ewers ..... E06B 7/20 49/315
491,952 A * 2/1893 Plympton ..... E06B 7/20 49/315
549,448 A * 11/1895 Deep ..... E06B 7/20 49/314
580,801 A * 4/1897 Ramsden ..... E06B 7/20 49/314
641,139 A * 1/1900 Ogan ..... E06B 7/20 49/314
672,929 A * 4/1901 Worley ..... E06B 7/20 49/314
719,599 A * 2/1903 Luchia ..... E06B 7/20 49/313
736,392 A * 8/1903 Henry ..... E06B 7/20 49/314
754,857 A * 3/1904 Fagon ..... E06B 7/20 49/311
770,330 A * 9/1904 Steger ..... E06B 7/20 49/314
1,470,874 A * 10/1923 Petersen ..... E06B 7/20 49/314
1,912,561 A * 6/1933 Williams ..... E06B 7/20 49/314
2,109,043 A * 2/1938 Davis ..... E06B 7/20 49/314
2,126,726 A * 8/1938 Brunker ..... E06B 7/20 49/311
2,321,730 A * 6/1943 Benson ..... E06B 7/20 49/314
2,541,451 A * 2/1951 Webster ..... E06B 7/20 49/314
2,566,070 A * 8/1951 Rhodes ..... E06B 7/20 49/314
2,602,973 A * 7/1952 Watson ..... E06B 7/20 16/94 R
2,786,244 A * 3/1957 Rapin ..... E06B 7/20 49/312
2,802,247 A * 8/1957 Anderson ..... E06B 7/20 49/314
2,929,116 A * 3/1960 Isbister ..... E06B 7/20 49/314
3,855,731 A * 12/1974 Yerkes ..... A47G 27/0425 15/216
4,716,683 A * 1/1988 Minter ..... E06B 7/22 49/479.1
4,974,364 A * 12/1990 Durham, Jr. ..... E06B 1/366 49/400
6,776,423 B1 * 8/2004 Guht ..... E06B 7/20 277/628

FOREIGN PATENT DOCUMENTS

FR 566640 A * 2/1924 ..... E06B 7/20
FR 570223 A * 4/1924 ..... E06B 7/20
GB 191329963 A * 0/1914 ..... E06B 7/20
GB 155381 A * 12/1920 ..... E06B 7/20
GB 163409 A * 5/1921 ..... E06B 7/20
GB 187128 A * 10/1922 ..... E06B 7/20
GB 264662 A * 1/1927 ..... E06B 7/20
GB 520 933 A 5/1940
GB 623864 A * 5/1949 ..... E06B 7/20
GB 786517 A * 11/1957 ..... E06B 7/20
GB 820333 A * 9/1959 ..... E06B 7/20
GB 862958 A * 3/1961 ..... E06B 7/20
GB 993232 A * 5/1965 ..... E06B 7/20

* cited by examiner

DOOR SEAL ASSEMBLY

CROSS-REFERENCE TO RELATED APPLICATION

This application claims priority from U.S. Application No. 61/871,946 filed Aug. 30, 2013, the entirety of which is incorporated herein by reference.

TECHNICAL FIELD AND BACKGROUND OF THE INVENTION

The present invention relates generally to a door seal assembly, and more particularly, to a door seal assembly configured to attach along the bottom edge of a door, the door seal configured to pivot about a rotational axis between a first position in contact with the floor when the door is closed and a second position out of contact with the floor when the door is open, thereby allowing the door to swing freely. Pivoting movement of the door seal assembly between the first and second positions is actuated by a lever in response to opening and closing the door.

It is generally known that door seals can be provided along the bottom edge of a door to seal the gap between the bottom of the door and the floor. Door seals are typically provided to ensure tight closure of the door and to prevent air from flowing between adjoining rooms through the gap, particularly where the adjoining rooms are kept at different temperatures, humidity levels, etc. One such example of adjoining rooms, to which the present invention finds particular application, is between passenger and storage compartments in an aircraft. For example, beverage carts may be stored in a room maintained at a lower temperature than the adjoining passenger compartment. A bottom door seal would thus be useful in this application to help maintain that temperature difference between the two rooms and prevent airflow therebetween when the door is closed.

Conventional door seals found along the edges of a door are fixed, and thus are incapable of accommodating obstacles on the floor (e.g., permanent obstacles and debris), restrain the swinging motion of the door, and drag along the floor as the door swings open and closed leading to premature wear on the seal. Worn seals become ineffective and must therefore be replaced, leading to increased costs and downtime. Further, fixed seals drag on the carpet as the door swings opened and closed, leading to premature wear on the carpet.

Therefore, to reduce premature wear on the door seal, protect the floor covering, and facilitate free swinging of the door, the present invention provides an improved door seal configured to automatically pivot into and out of contact with the floor as the door is opened and closed.

BRIEF SUMMARY OF THE INVENTION

It is therefore an object of the present invention to provide a bottom door seal configured to seal the gap between the bottom of a door and the floor.

It is a further object of the invention to provide a door seal configured to pivot out of contact with the floor when the door is open to prevent premature wear on the seal and the floor covering when the door swings.

It is a further object of the invention to provide an actuated door seal that automatically moves to a position into contact with the floor when the door is closed, thereby effecting a floor seal, and moves to a position out of contact with the floor when the door is open, thereby allowing the door to swing freely.

It is a further object of the invention to provide a door seal configured for hands-free operation.

To achieve the foregoing and other objects and advantages, in a first embodiment the present invention provides a door assembly including a door configured to swing open and closed, a sealing member pivotally attached along a bottom edge of the door configured to pivot between a first position into contact with the floor and a second position out of contact with the floor, a lever arranged to actuate pivoting movement of the sealing member in response to opening and closing the door, and a biasing member arranged to bias the lever toward a non-actuating position and the sealing member toward the second position.

In a further aspect, the door assembly may include a deployment stop separate from the door positioned to actuate the lever to move the sealing member to the first position when the door is closed.

In a further aspect, closing the door may cause the deployment stop to urge the lever in a direction toward the door and the sealing member toward the first position, and opening the door may cause the biasing member to urge the lever in a direction away from the door and the sealing member toward the second position.

In a further aspect, the sealing member and the lever may be integrally formed and extend in opposite directions from the door.

In a further aspect, the sealing member and the lever may pivot about a common horizontal pivot axis arranged along the bottom edge of the door.

In a further aspect, the sealing member may include an elongate rigid strip having a plurality of bristles extending therefrom in a common direction.

In a further aspect, the plurality of bristles may be resiliently deformable to accommodate obstacles in the path of the door.

In a further aspect, closing the door may urge the lever in the direction toward the door and the sealing member toward the first position, and opening the door may cause the biasing member to urge the lever in the direction away from the door and the sealing member toward the second position.

In a further aspect, the sealing member may extend along the length of the bottom of the door.

In another embodiment, provided herein is a door seal assembly configured to be attached along the bottom of a door, the door seal assembly including a sealing member adapted to be pivotally attached along the bottom of the door configured to pivot between a first position into contact with the floor and a second position out of contact with the floor, a lever arranged to actuate pivoting movement of the sealing member in response to opening and closing the door, and a biasing member arranged to bias the lever toward a non-actuating position and the sealing member toward the second position.

In a further aspect, the door seal assembly may include a deployment stop separate from the lever adapted to be arranged near the door and actuate the lever when the door is closed.

In a further aspect, closing the door may cause the lever to move into contact with the separate deployment stop, thereby urging the lever in a direction toward the door and pivoting the sealing member toward the first position into contact with the floor.

In a further aspect, opening the door may cause the lever to move out of contact with the separate deployment stop, thereby allowing the biasing member to urge the lever in the direction away from the door and consequently pivoting the sealing member toward the second position out of contact with the floor, the second position being elevated from the floor.

In yet another embodiment, provided herein is a door assembly including a door, a sealing member pivotally attached along a bottom edge of the door configured to move between a first position into contact with the floor and a second position out of contact with the floor, a lever arranged to pivot the sealing member between the first and second positions as the door is opened and closed, a biasing member arranged to bias the actuating lever toward a non-actuating position, and a separate deployment stop arranged to actuate the actuating lever when the door is closed.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to the figures, embodiments of a door seal assembly and a door assembly including a seal are provided and generally include a bottom door seal configured to move (e.g., pivot) between a first position in contact with the underlying floor when the door is closed, and a second position in which the seal is raised from the floor (i.e., elevated) when the door is open, thereby sealing the door when closed and allowing the door to swing freely when open. The ability to raise the seal as the door swings further protects the seal from premature wear and prevents wear to the underlying floor covering (i.e., carpet), among other advantages.

The assemblies described herein employ an actuator (e.g., lever) for moving the seal, the actuator arranged to engage a deployment stop or like structure as the door is near closed and closed. This arrangement allows the seal to deploy "automatically" when the door is closed, thus providing hands-free deployment and deployment simultaneous with the door closing. The assembly may be configured as a retrofit kit to be fitted to an existing door, or may be provided as a complete door assembly. The assemblies described herein may be used to provide a bottom door seal in any application, and are particularly suited to applications in which there may be permanent and/or temporary obstacles in the path of the doorway. Although the door seal is described herein as a bottom door seal, it is envisioned that the seal may easily be adapted for use as a side or top door seal.

Figure 1:
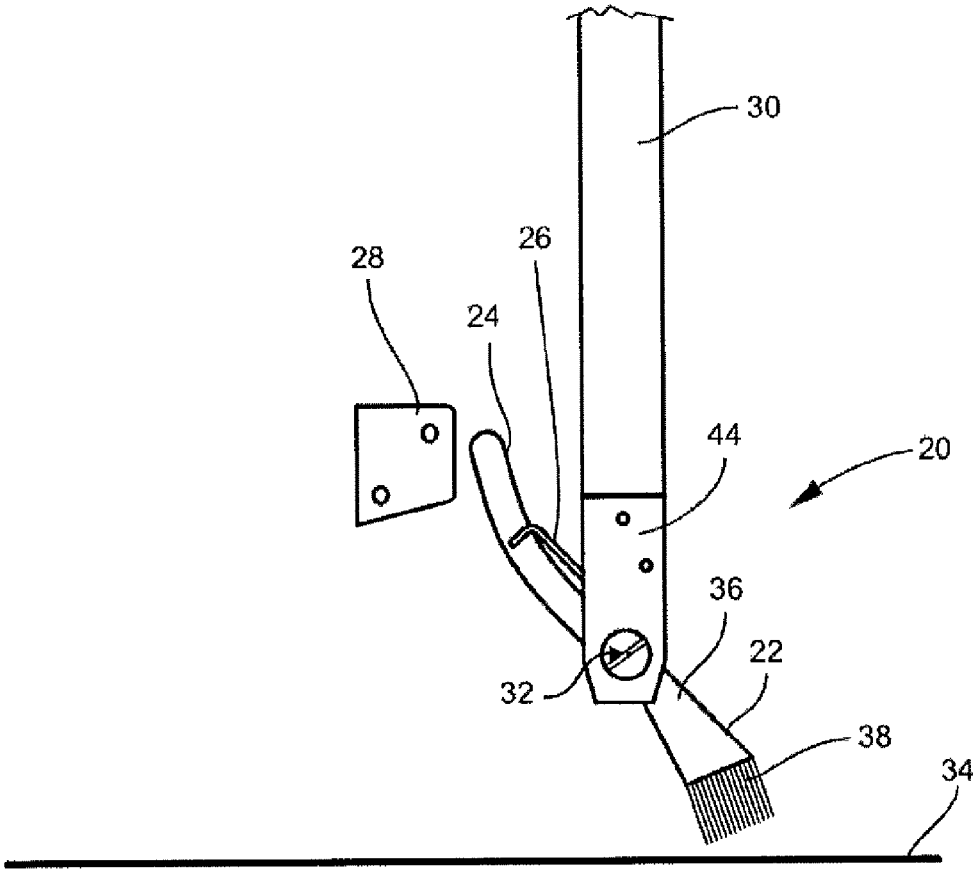
FIG. 1 is a side elevation view of a door seal assembly according to an embodiment of the invention showing the door seal out of contact with the floor (i.e., elevated)
Figure 2:
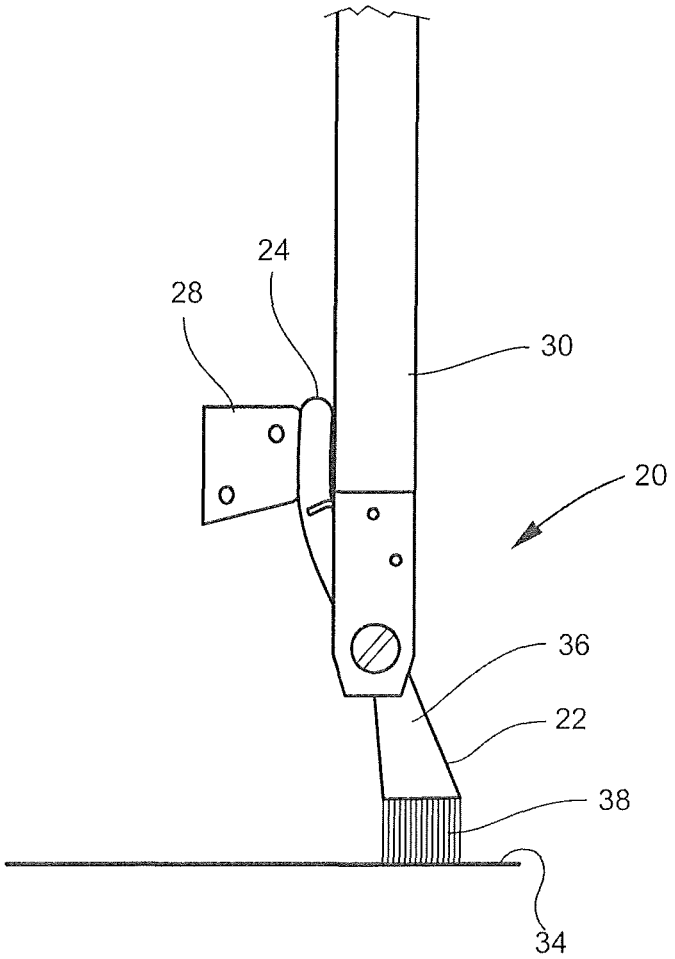
FIG. 2 is a side elevation view of the door seal assembly of FIG. 1 showing the door seal in contact with the floor.
Figure 3:
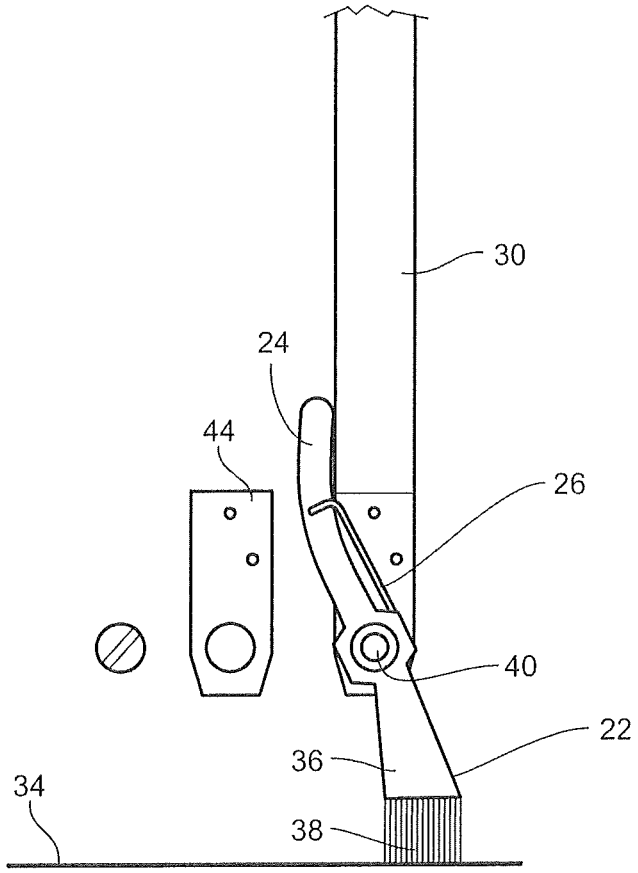
FIG. 3 is a side elevation view of the door seal assembly of FIG. 1 shown with side cover plate removed.

Referring to FIGS. 1-3, the door seal assembly according to an embodiment of the invention is shown generally at reference numeral 20. The door seal assembly 20 generally includes a sealing member 22 adapted to be pivotally attached along the bottom or bottom edge of a door 30, and a lever 24 arranged to actuate rotational (e.g., pivoting) movement of the sealing member in response to opening and closing the door. The sealing member 22 and the lever 24 may be integrally formed and pivot in opposite directions about a common pivot axis 32. As shown, the sealing member 22 and lever 24 may pivot about an elongate cylindrical rod 40 arranged horizontally along the bottom edge of the door 30. The rod 40 may be held at its opposing ends by a pair of spaced cover plates 44 that permit the rod 40 and/or sealing member and lever arrangement to pivot about pivot axis 32. As shown, the actuating lever 24 diametrically opposes the sealing member 22 about the rod member 40, and actuates the deployment and retraction of the sealing member as the lever is moved.

The door seal assembly 20 further includes a biasing member 26 arranged to bias the lever 24 in the direction away from door 30, and a separate deployment stop 28 positioned to engage the lever 24 to actuate the lever as the door nears closed and is fully closed. In this arrangement, the biasing member 26 is able to urge the lever 24 in the direction away from the door 30 when the lever is out of contact with the deployment stop 28 when the door is open to a certain degree, thereby automatically raising the sealing member 22. As shown, the biasing member 26 may take the form of a torsion spring that rotates about the pivot axis 32 to create a load as the lever 24 is urged in the direction of the door 30 when the door is closed, and releases the load in an arc around the pivot axis 32 when the lever 24 is out of contact with the deployment stop 28. The degree of rotation of the torsion spring may be less than about 90 degrees, and is more preferably about 45 degrees.

The deployment stop 28 is positioned in the vicinity of the lever 24 so as to contact the lever as the door is near closed and remains closed. The deployment stop 28 thus may be attached to, for example, the doorjamb or other portion of the frame to which the door 30 is hung, the wall supporting the doorjamb, a wall adjacent the doorjamb (e.g., a wall perpendicular to the doorjamb wall). The deployment stop 28 may also be floor mounted. The deployment stop 28 may be mounted to the door frame or adjacent thereto about the hinged side or leading side of the door 30 at a position such that the lever 24 contacts the deployment stop as the door nears closing. The deployment stop 28 may be recessed from the doorjamb a slight distance such that the lever is moved during the final few degrees of movement of the door 30 and space is provided between the door and deployment stop to accommodate the lever when the door is fully closed. The deployment stop 28 may be constructed from any material, and in a specific embodiment is constructed from an elastomeric material to help absorb the impact forces from the lever 24 and door 30.

In this arrangement, the lever 24 is biased away from the door 30 when the door is partly to fully open. As the door 30 nears closing, the lever 24 contacts the deployment stop 28. The force applied to continuing the closing movement of the door 30 urges the lever 24 in the direction of the door, thereby loading the biasing member 26. When the door 30 is fully closed, the lever 24 is closest the door and the biasing member 26 is maximally loaded. When the door 30 is opened, the biasing member 26 unloads to urge the lever 24 in the direction away from the door. When the lever 24 is out of contact with the deployment stop 28, the biasing member 26 is able to urge the lever to its furthest position from the door. The degree of rotation of the lever 24, lever length, spring force, and position of the deployment stop 28 may be adjusted to customize the initial point of contact between the lever and deployment stop and consequently moving the sealing member 22 based on a certain angle of the door.

The door 30 shown is hinged along one side and pivots about a vertical axis to one side of the frame. The door seal assembly 20 may be used with other door types including, but not limited to, rollaway doors that open and close vertically. A specific application for the door seal assembly 20 includes providing a seal beneath a cart bay door in an aircraft where airflow beneath the door is prevented when the door is closed. Other applications within an aircraft and outside of aircraft interior upfittings are envisioned.

The connection between the actuating lever 24 and the sealing member 22, and in a particular embodiment the integral construction of the two components, causes the sealing member to move (e.g., rotate or pivot) simultaneously with the movement of the lever. Thus, the lever 24 actuates the pivoting movement of the sealing member 22, and in particular, rotational movement in an opposite direction around pivot axis 32.

Figure 4:
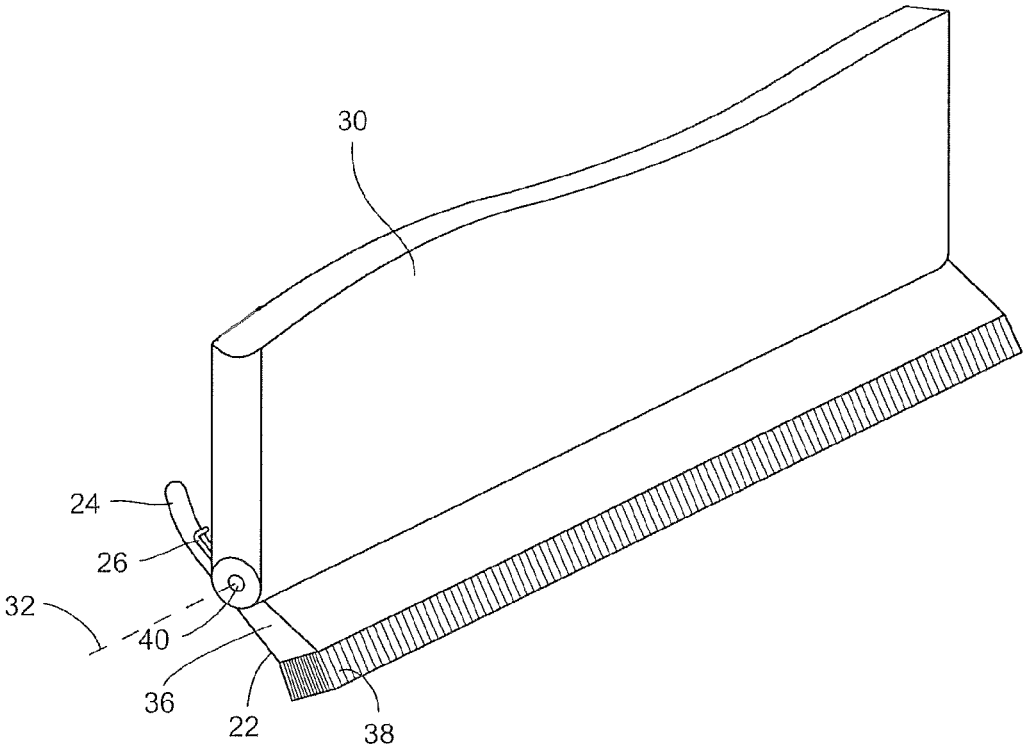
FIG. 4 is a perspective view showing the door seal assembly in a position out of contact with the floor.

Referring to FIGS. 1 and 4, when the door 30 is at least partly open, the sealing member 22 is positioned out of contact with the floor 34, referred to herein as the "second position," thereby allowing the door to swing freely. The term "out of contact" as used herein may mean raised, retracted or elevated relative to the floor 34, and to any degree or height. Thus, in the second position, the sealing member 22 is out of contact with the floor surface in general, but may come into contact with an obstacle on the floor. Permanent obstacles on the floor 34 may include, but are not limited to, thresholds, conduits, cabling and lighting strips. Temporary obstacles on the floor may include, but are not limited to, debris and area rugs.

Figure 5:
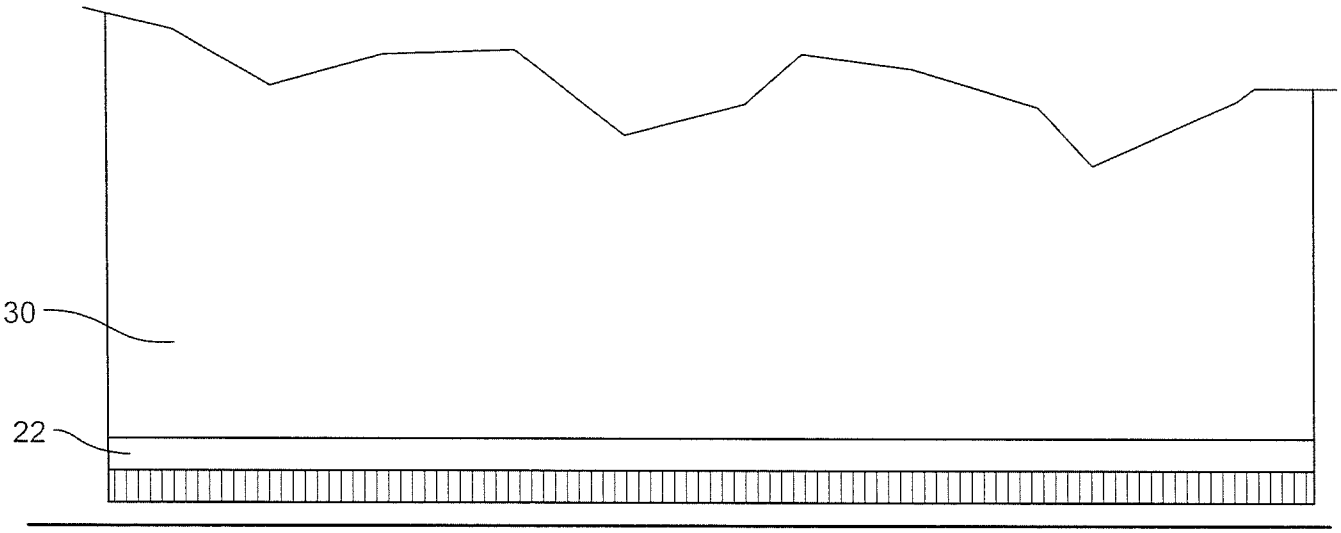
FIG. 5 is a front elevation view showing the door seal assembly in a position out of contact with the floor, thereby providing a gap between the door seal and the floor allowing the door to swing freely.

The lever 24 and sealing member 22 extend in generally opposite directions. For example, in the second position, the sealing member 22 may extend away from the front of the door 30 and point downward, and the lever 24 may extend in the general opposite direction away from the back of the door pointing upward, depending on the perspective of the observer. The lever 24 and sealing member 22 are arranged in a general linear configuration, although the lever may have a slight curve to lessen the force required to close the door as the door nears closing. FIG. 5 illustrates the gap between the bottom of the sealing member 22 and the floor when the sealing member is in the second position.

Figure 6:
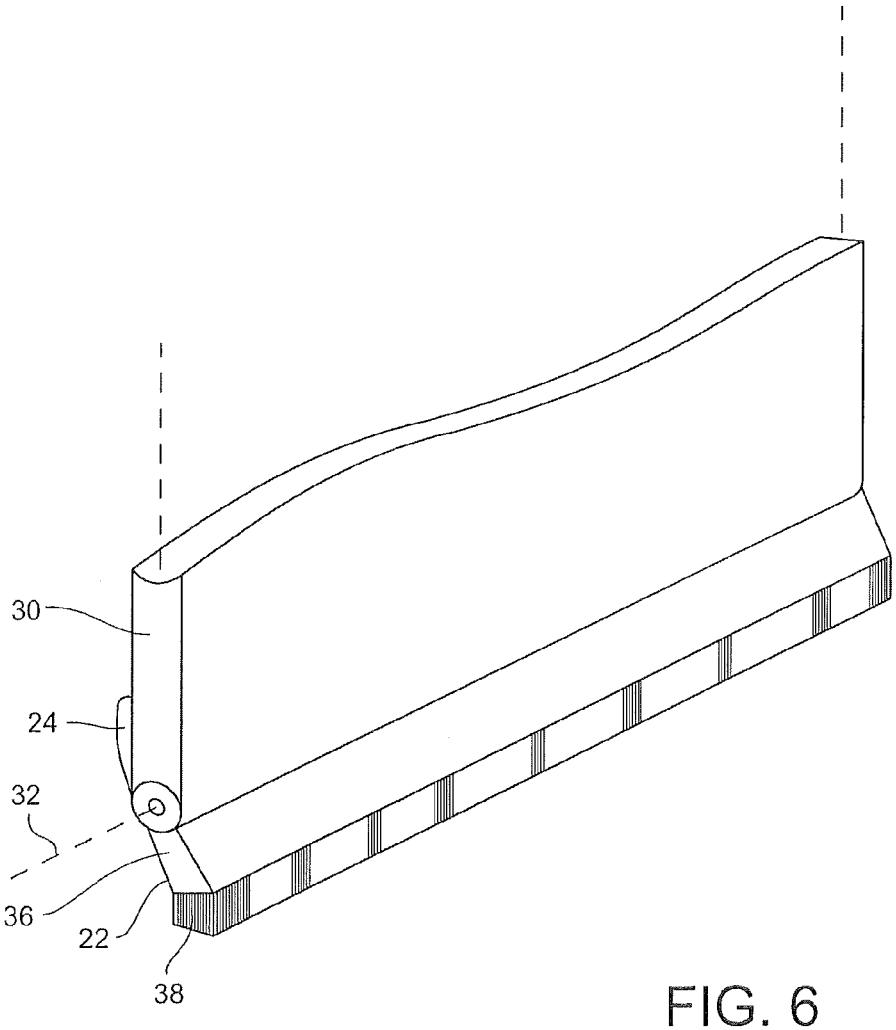
FIG. 6 is a perspective view showing the door seal assembly in contact with the floor.
Figure 7:
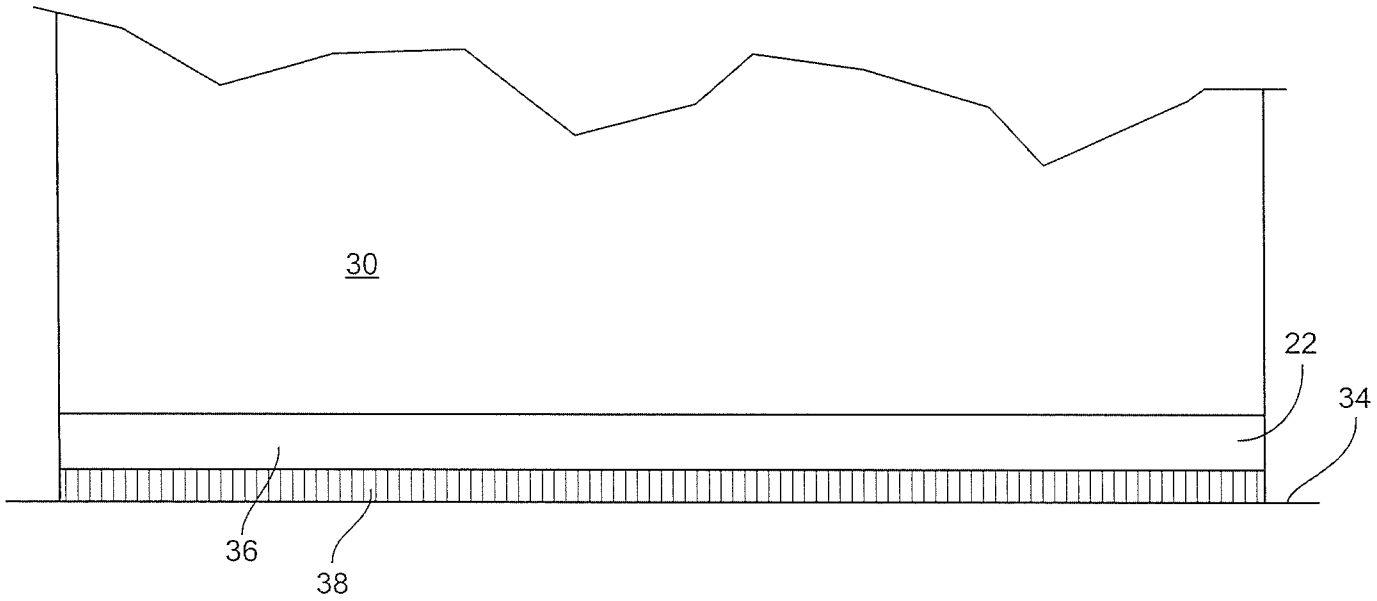
FIG. 7 is a front elevation view showing the door seal assembly in contact with the floor thereby effecting a seal at the bottom of the door when the door is closed.

Referring to FIGS. 2 and 6, when the door 30 is fully closed, the lever 24 is urged to a position against the back of the door and the sealing member 22 is arranged generally vertically to make contact with the floor 34, referred to herein as the "first position" of the sealing member 22. In the first position, the sealing member 22 contacts the floor to seal off the air gap between the bottom of the door and the floor as illustrated in FIG. 7.

Referring to FIGS. 1-4 and 6, the sealing member 22 may include an elongate rigid strip 36 having a plurality of bristles 38 extending therefrom in a common direction. In an alternative embodiment, the elongate strip may be elastomeric and resiliently deformable. The actuating lever 24 may be an extension of the rigid strip 36 about the rod member 40. In an alternative embodiment, the rod member 40 may rotate and the lever 24 and rigid strip 36 may be fixed to the rod member, either cooperatively or independently.

The rigid strip 36 spans substantially the length of the door 30, although partial lengths are envisioned. The rigid strip 36 may be attached around the elongate rod 40 that may itself rotate about pivot axis 32, or may be rotationally fixed and about which the sealing member 22 rotates. The bristles 38 are preferably resiliently deformable to accommodate uneven floor surfaces and permanent and temporary obstacles on the floor 34, such as those described above. Resiliently deformable bristles further relax the need for exact placement of the door seal assembly 20 relative to the floor. In other words, the bristles 38 are able to deform (e.g., bend) slightly in the event the door seal assembly 20 is taller than the gap beneath the door. A seal other than a brush seal is also envisioned.

In specific embodiments, the rigid strip 36 may be constructed from metal, plastic, molded thermoplastic resin or a combination thereof configured to hold or receive the bristles 38. In the case of a brush seal, the rigid strip 36 may be molded in and around the bristles. The brush seal may include a uniform arrangement of bristles, and in certain aspects, the brush seal can prevent, for example, 98.5% or more, and more preferably 99% or more, air infiltration. In the case of a resilient, elastomeric seal, the seal may be constructed from unsaturated rubbers, saturated rubbers, thermoplastic elastomers, etc. In specific examples, the resilient elastomeric strip seal can include p-type or l-type silicon. A resilient elastomeric seal may be preferred in applications for stopping fluid flow.

In use, the actuating lever 24 extends upward at an oblique angle relative to the vertical plane of the door 30. As the actuating lever 24 is moved (e.g., urged) in the direction of the door 30 (i.e., as the angle between the actuating lever and the vertical plane of the door decreases), the rigid strip 36 rotates in the clockwise direction to position the sealing member 22 substantially vertical. In other words, movement of the actuating lever 24 in the direction of the door 30 causes the sealing member 22 to move from a position at an oblique angle relative to the floor to a substantially vertical position, thereby sealing the gap between the bottom of the door and the floor.

In a specific application, the door seal assembly 20 or a door including the door seal assembly may be utilized as a galley cart bay doorway. For example, in aircraft, galley carts can be stored in galley cart bays, and it is advantageous to provide a door seal assembly described herein on a door in the galley cart bay to reduce the physical wear and tear of the aircraft's floor and/or to reduce slipping hazards sometimes attributed with conventional door seal assemblies.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A door assembly, comprising:

a door configured to swing open and closed;

a sealing member pivotally attached to a bottom horizontal surface of the door perpendicular to opposing faces of the door, the sealing member configured to pivot between a first position into contact with a floor and a second position out of contact with the floor;

a lever arranged to actuate pivoting movement of the sealing member in response to opening and closing the door; and a biasing member arranged to bias the lever toward a non-actuating position and the sealing member toward the second position;

wherein the lever and the sealing member extend in opposite directions away from respective opposing faces of the door.

2. The door assembly of claim 1, further comprising a deployment stop separate from the door and positioned to actuate the lever to move the sealing member to the first position when the door is closed.

3. The door assembly of claim 2, wherein closing the door causes the deployment stop to urge the lever in a direction toward the door and the sealing member toward the first position, and opening the door causes the biasing member to urge the lever in a direction away from the door and the sealing member toward the second position.

4. The door assembly of claim 1, wherein the sealing member and the lever are integrally formed.

5. The door assembly of claim 1, wherein the sealing member and the lever pivot about a common horizontal pivot axis arranged along a bottom of the door.

6. The door assembly of claim 1, wherein the sealing member comprises an elongate rigid strip having a plurality of bristles extending therefrom in a common direction.

7. The door assembly of claim 6, wherein the plurality of bristles are resiliently deformable.

8. The door assembly of claim 1, wherein closing the door urges the lever in a direction toward the door and the sealing member toward the first position, and opening the door causes the biasing member to urge the lever in a direction away from the door and the sealing member toward the second position.

9. The door assembly of claim 1, wherein the sealing member extends along a length of a bottom of the door.

10. A door seal assembly, comprising:

a sealing member adapted to be pivotally attached to a bottom horizontal surface of a door perpendicular to opposing faces of the door, the sealing member configured to pivot between a first position into contact with a floor and a second position out of contact with the floor;

a lever arranged to actuate pivoting movement of the sealing member in response to opening and closing the door to which the sealing member is attached; and a biasing member arranged to bias the lever toward a non-actuating position and the sealing member toward the second position;

wherein the lever and the sealing member extend in opposite directions away from respective opposing faces of the door.

11. The door seal assembly of claim 10, further comprising a deployment stop separate from the lever adapted to be arranged near the door and actuate the lever when the door is closed.

12. The door seal assembly of claim 10, wherein the sealing member and the lever are integrally formed.

13. The door seal assembly of claim 10, wherein the sealing member and the lever pivot about a common horizontal pivot axis along the bottom horizontal surface of the door.

14. The door seal assembly of claim 10, wherein the sealing member comprises an elongate rigid strip having a plurality of bristles extending therefrom in a common direction.

15. The door seal assembly of claim 14, wherein the plurality of bristles are resiliently deformable.

16. The door seal assembly of claim 10, wherein closing the door urges the lever in a direction toward the door and the sealing member toward the first position, and opening the door causes the biasing member to urge the lever in a direction away from the door and the sealing member toward the second position.

17. The door seal assembly of claim 10, wherein the sealing member is configured to extend along a length of the bottom horizontal surface of the door.

18. The door seal assembly of claim 10, wherein the lever is arranged to pivot the sealing member toward the first position when the door is closed and toward the second position when the door is open.

19. A door assembly, comprising:

a door;

a sealing member pivotally attached to a bottom horizontal surface of the door perpendicular to opposing faces of the door configured to move between a first position into contact with a floor and a second position out of contact with the floor;

a lever arranged to pivot the sealing member between the first and second positions as the door is opened and closed;

a biasing member arranged to bias the lever toward a non-actuating position; and a separate deployment stop arranged to actuate the lever when the door is closed;

wherein the lever and the sealing member extend in opposite directions away from respective opposing faces of the door.

20. The door assembly of claim 19, wherein the sealing member comprises an elongate rigid strip having a plurality of bristles extending therefrom in a common direction.

* * * * *